US005901918A

United States Patent [19]

Klerelid et al.

[11] Patent Number: 5,901,918

[45] Date of Patent: May 11, 1999

[54] APPARATUS AND METHOD FOR WINDING PAPER

[75] Inventors: Bernt Erik Ingvar Klerelid, Karlstad; Tommy Rolf Karlsson, Göteborg, both of Sweden; Randall James Le Valley, Marysville, Wash.; Ronald Frederick Gropp, St. Catharine's, Canada; Philip Sim Lin, Oshkosh, Wis.; Brian Douglas Klaubert, Aiken, S.C.

[73] Assignee: Valmet-Karlstad AB, Karlstad, Sweden

[21] Appl. No.: 08/888,062

[22] Filed: Jul. 3, 1997

[51] Int. Cl.[6] ..... B65H 18/08; B65H 18/26; B31C 11/00

[52] U.S. Cl. ..... 242/534; 242/532.2; 242/535.4; 242/540; 242/547; 162/118; 162/283

[58] Field of Search ..... 242/532.2, 534, 242/535.4, 540, 547, 548; 162/118, 283

[56] References Cited

U.S. PATENT DOCUMENTS

| | | | |
|---|---|---|---|
| 3,224,698 | 12/1965 | Conti | 242/547 |
| 3,707,749 | 1/1973 | Henley | 492/4 |
| 4,143,828 | 3/1979 | Braun et al. | 242/541.3 |
| 4,193,559 | 3/1980 | Ballard | 242/547 |
| 4,283,023 | 8/1981 | Braun et al. | 242/535.4 |
| 4,792,076 | 12/1988 | Grunder | 226/175 |
| 5,335,871 | 8/1994 | Fissmann et al. | 242/595.1 |
| 5,379,961 | 1/1995 | Urban et al. | 242/525.7 |
| 5,531,396 | 7/1996 | Kinnunen et al. | 242/526.3 |
| 5,591,309 | 1/1997 | Rugowski et al. | 162/283 |
| 5,607,551 | 3/1997 | Farrington, Jr. et al. | 162/109 |
| 5,673,870 | 10/1997 | Fielding et al. | 242/542.3 |

FOREIGN PATENT DOCUMENTS

| | | |
|---|---|---|
| 0 157 062 B1 | 10/1985 | European Pat. Off. . |
| 0 483 093 B1 | 4/1992 | European Pat. Off. . |
| 0483092A1 | 4/1992 | European Pat. Off. . |
| 0 556 252 B1 | 8/1993 | European Pat. Off. . |
| 0 638 500 A1 | 2/1995 | European Pat. Off. . |
| 0 683 125 A2 | 11/1995 | European Pat. Off. . |
| 97200848 | 3/1997 | European Pat. Off. . |
| 42 08 790 | 9/1993 | Germany . |
| WO 95/13980 | 5/1995 | WIPO . |

OTHER PUBLICATIONS

Tord Svanqvist, *Reel Design for Soft Tissue*, 1991 Tissue Making Seminar, pp. 165–178 (Sep. 19–20).

Tuomisto, et al., Eliminating production losses on a paper machine reel, Tappi Journal, vol. 78, No. 10, pp. 191–195.

Sales brochure, Valmet Paper Machinery, Inc., The new Valmet Optireel increases your sales margin.

Sales brochure, Valmet Paper Machinery, Valmet OPTIR-EEL™, 1992.

Sales brochure, Valmet Paper Machinery, Valmet OPTIR-EEL™, 1993.

*Primary Examiner*—John Q. Nguyen

*Attorney, Agent, or Firm*—Bell Seltzer Intellectual Property Law Group of Alston & Bird LLP

[57] ABSTRACT

An apparatus and method for winding tissue webs into a parent roll is disclosed which results in greater uniformity in sheet basis weight, machine direction stretch and bulk when comparing the corresponding sheet properties taken from representative locations throughout the roll. The apparatus and method includes engaging the tissue web against a reel spool with a flexible member such as a transfer belt which traverses an unsupported span between two support rolls. The web is transferred from the transfer belt to the parent roll as the parent roll is urged against the sheet/transfer belt at a point within the unsupported span. The resulting deflection of the transfer belt is detected and, in response, the reel spool position is changed to control the deflection at a desired level. Accordingly, a predetermined light nip pressure can be applied to the roll as the tissue web is wound thereon and large parent rolls of high bulk tissue can be manufactured with desired properties when unwound.

25 Claims, 3 Drawing Sheets

APPARATUS AND METHOD FOR WINDING PAPER

FIELD OF THE INVENTION

The present invention relates to papermaking, and more particularly relates to apparatus and methods for winding tissue manufactured on a papermaking machine.

BACKGROUND OF THE INVENTION

In the manufacture of various types of tissue products such as facial tissue, bath tissue, paper towels and the like, the dried tissue web or sheet coming off of the tissue machine is initially wound into a parent roll and temporarily stored for further processing. Sometime thereafter, the parent roll is unwound and the sheet is converted into a final product form.

In winding the tissue web into a large parent roll, it is vital that the roll be wound in a manner which prevents major defects in the roll and which permits efficient conversion of the roll into the final product, whether it be boxes of facial tissue sheets, rolls of bath tissue, rolls of embossed paper towels, and the like. Ideally, the parent roll has an essentially cylindrical form, with a smooth cylindrical major surface and two smooth, flat, and parallel end surfaces. The cylindrical major surface and the end surfaces should be free of ripples, bumps, waviness, eccentricity, wrinkles, etc., or, in other words, the roll should be "dimensionally correct." Likewise, the form of the roll must be stable, so that it does not depart from its cylindrical shape during storage or routine handling, or, in other words, the roll should be "dimensionally stable." Defects can force entire rolls to be scrapped if they are rendered unsuitable for high speed conversion.

Many defects can be introduced by improper winding, especially when winding high bulk, easily-compressible, soft tissue webs. A large number of such defects are discussed and shown in photographs in an article by W. J. Gilmore, "Report on Roll Defect Terminology—TAPPI CA1228," Proc. 1973 Finishing Conference, Tappi, Atlanta, Ga., 1973, pp. 5–19. Inadequate web stress near the core of the roll may cause the outer regions of the roll to compress the roll inwardly, leading to buckling in a starred pattern, commonly called "starring", as described by James K. Good, "The Science of Winding Rolls", *Products of Papermaking, Trans. of the Tenth Fundamental Research Symposium at Oxford*, Sept. 1993, Ed. C. F. Baker, Vol. 2, Pira International, Leatherhead, England, 1993, pp. 855–881. Furthermore, starring causes the release of the tension of the web around the core that normally provides sufficient friction between the core and adjacent layers of the web. This loss of friction can result in core "slipping" or "telescoping", where most of the roll (except for a few layers around the core and a few layers around the outermost regions) moves en masse to one side with respect to the axis of the roll, rendering the roll unusable.

Current commercially available hard nip drum reels of the type with center-assisted drives, as described by T. Svanqvist, "Designing a Reel for Soft Tissue", 1991 Tissue Making Seminar, Karlstad, Sweden, have been successfully used to wind rolls of compressible tissue webs having bulks of up to about 8 to 10 cubic centimeters per gram, while avoiding the above-mentioned winding problems, by reducing the nip force and relying mainly on the in-going web tension control through modulation of the center-assisted drive for the coreshaft. However when using such methods to wind tissue sheets having bulk of 9 cubic centimeters per gram or higher and a high level of softness, as characterized, for example, by an MD Max Slope of about 10 kilograms or less per 3 inches of sample width, these problems will recur. These winding problems are accentuated when attempting to wind large rolls with diameters from about 70 inches to about 150 inches or greater, particularly at high speeds.

Without wishing to be bound by theory, it is believed that when a web is brought into a nip formed between the parent roll and a pressure roll, two major factors besides the in-going web tension affect the final stresses inside a wound roll. Firstly, the portion of the parent roll in the nip is deformed to a radius which is smaller than the undeformed radius of the parent roll. The expansion of the parent roll from its deformed radius to its undeformed radius stretches the web and results in a substantial internal tension increase from the set tension of the web going into the nip.

Another factor is sometimes called the "secondary winding" effect. A portion of the web is added to a roll after it passes first through the nip between the parent roll and the pressure roll. It then passes under the nip repeatedly at each rotation of the parent roll while more layers are added on the outer diameter. As each point near the surface of the roll reenters the nip, the web is compressed under the nip pressure, causing air in the void volume of the web to be expelled between the layers. This can reduce the friction between the layers sufficiently to allow the layers to slide tighter around the inner layers, as described by Erickkson et al., *Deformations in Paper Rolls*, pp. 55–61 and Lemke, et al., *Factors involved in Winding Large Diameter Newsprint Rolls on a Two-Drum Winder*, pp 79–87 Proc. of the *First International Conference on Winding Technology,* 1987.

The tension in each layer as it is added to the parent roll causes a compression force exerted by the outer layer to the layers underneath, thus the cumulative effect of compression from the outer layers will normally cause the web at the region around the core to have the highest interlayer pressure. The secondary winding further adds to this pressure. Soft tissue is known to yield when subjected to compression, thus absorbing some of the increases in pressure to the extent that it loses its ability to deform. Consequently, the cumulative pressure can rise at a steep rate to excessive levels that can cause a wide variation in the sheet properties unwound from the parent rolls.

Unfortunately, the internal pressure and web tension gradient that exists along the radius of a conventionally wound parent roll, while successful in preventing dimensional stability problems, can lead to undesired variability in the properties of the web. High tension in some regions causes some of the machine direction stretch to be pulled out during winding, and high internal pressure results in loss of bulk. Upon unwinding, regions that have been stretched more by high tension in and after the nip will have lower basis weight because of longitudinal stretching of the web. These changes in crucial web properties lead to variability in product quality and difficulties in converting operations.

Compensating for the internal pressure buildup, according to the above-mentioned method described by T. Svanqvist, can be carried only to a certain extent. As the density and strength of the web material is reduced much lower than the levels cited, uncertainties in the magnitude of frictional forces in the winding apparatus and other factors which change during the course of winding a roll make precise nip loading control very difficult. Alternatively, loss of control of the winding process can result in a reversal in tension gradient that can lead to the starring and core slippage problems described above.

Pure center winding without a nip is known for some delicate materials, but with tissue webs of the types discussed above high web tension would be needed to apply adequate pressure in the roll and machine direction stretch would be reduced. With pure center winding, tension near the core needs to be higher to prevent telescoping of the roll and other defects. Pure center winding also suffers from speed limitations. At higher speeds, web tension would be too high and sheet flutter would lead to breaks and poor reeling.

Most tissue machines in commercial operation have what is termed an "nopen draw" between the dryer and the reel, meaning the dried sheet is unsupported over the distance between the dryer and the reel. More recently, in an effort to improve productivity by reducing sheet breaks in manufacturing, a tissue machine has been designed to include a supporting fabric for carrying the dried sheet from the dryer to the reel without an open draw. Such a machine, as disclosed in U.S. Pat. No. 5,591,309 to Rugowski et al., entitled "Papermaking Machine For Making Uncreped Throughdried Tissue Sheets", illustrates a hard nip between the reel spool or the parent roll and the winding drum to effect transfer of the sheet from the fabric to the reel or the parent roll. For many tissue sheets, the presence of the hard nip at this point in the process is not a problem because the sheet is relatively dense and can withstand the amount of compression it experiences without detriment to final product quality. However, for some recently developed tissue sheets, particularly soft, high bulk uncreped throughdried tissue sheets as disclosed in U.S. Pat. No. 5,607,551 to Farrington, Jr. et al., it has been found that traditional winding methods are unable to reliably produce a parent roll with appropriate web tension and radial pressure throughout to yield an unwound sheet of substantially uniformity.

Therefore there is a need for a method of winding soft, bulky tissue sheets in which the variability in sheet bulk, caliper, machine direction stretch and/or basis weight is minimized, while still maintaining parent roll characteristics that are favorable to manufacturing and converting operations.

SUMMARY OF THE INVENTION

These and other needs are met by the apparatus and method according to the present invention which includes an endless flexible member for engaging the web of tissue paper against a reel spool. The endless flexible member thus forms a "soft nip" with the reel spool. A deflection sensor is mounted adjacent to the flexible member at the nip point for measuring the amount of deflection of the flexible member. The amount of deflection is related to the pressure at the nip point and, by moving the reel spool and flexible member away from each other as the diameter of the paper roll increases, the pressure can be controlled at a desired level. Accordingly, the tissue winding parameters are greatly improved and the differences in properties of an unwound paper roll can be minimized.

More particularly, it has now been discovered that soft, bulky tissue sheets can be wound onto a parent roll with minimal sheet degradation by carrying the sheet from the dryer to a motor driven reel spool while supported by a flexible transfer belt, which preferably has little or no air permeability. The transfer belt traverses an unsupported or free span between two support rolls and transfers the sheet to the reel or parent roll at a point where the transfer belt is no longer in contact with the support rolls, generally at a point along the unsupported span about midway between the support rolls. At the point of transfer, the reel spool or the parent roll is urged only slightly against the sheet/transfer belt such that the transfer belt is slightly deflected or bowed.

It has been found that the degree of deflection is an important variable which can advantageously be controlled to improve the uniformity of the sheet throughout the resulting parent roll. Control of the deflection is attained by directing a laser or other distance measuring device(s) at the underside of the transfer belt to detect and measure the degree to which the transfer belt is deflected at the point of sheet transfer. If the transfer belt is deflected beyond a predetermined limit, the position of the reel spool relative to the transfer belt is adjusted to either increase or decrease the distance between the reel spool and the transfer belt.

By controlling this distance to a small value during the entire time the parent roll is building, the nip force between the parent roll and the surface of the transfer belt is minimized to a level much lower than can be attained from the hard nip of a pressure roll. This in turn eliminates the effects of nip stretching and secondary winding while allowing the web tension dictated by the center drive system to be a bigger factor in controlling the interlayer tension in the roll. The uncertainties associated with measuring small nip forces and changing bearing friction during the building of the roll are completely obviated.

Parent rolls wound on a winder in accordance with this invention have an internal pressure distribution such that the peak pressure at the core region reaches values lower than those attained from a conventional reel, yet which are sufficient to maintain the mechanical stability required for normal handling. The parent rolls from the method of this invention have an internal pressure near the core which decreases to a certain level and then displays a significant region with an essentially flat pressure profile, except for the inevitable drop to low pressure at the outer surface of the roll. Thus, the uniformity of sheet properties throughout the parent roll is substantially improved.

DETAILED DESCRIPTION OF THE DRAWINGS

Figure 1:
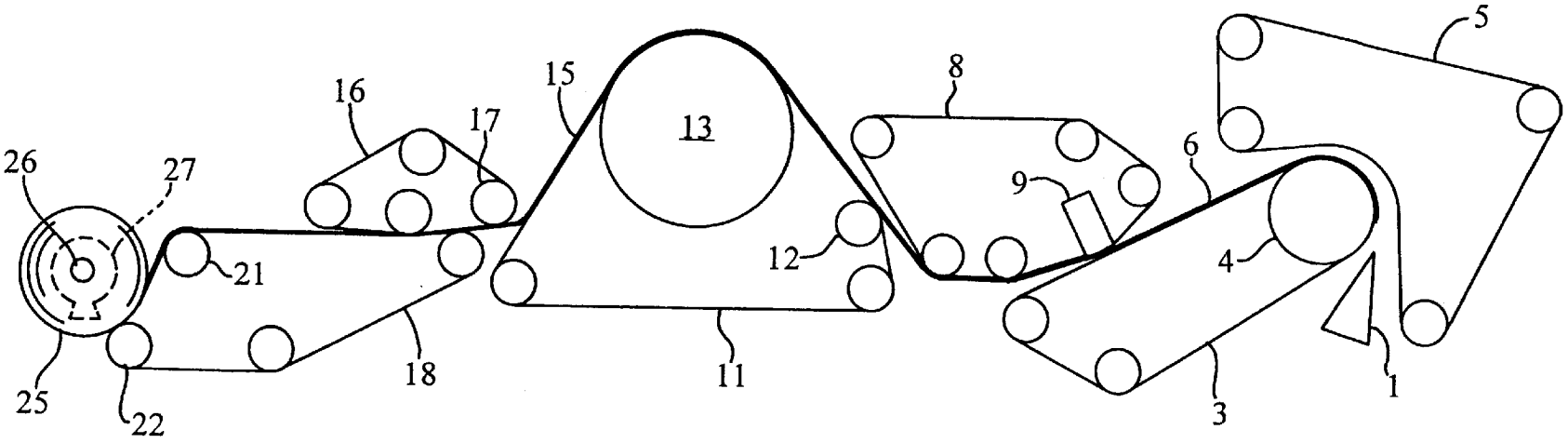
FIG. 1 is a schematic process flow diagram of a method for making soft high bulk tissue sheets in accordance with this invention.

FIG. 1 shows is a schematic flow diagram of a throughdrying process for making uncreped throughdried tissue sheets. It should be understood, however, that the present invention could also be used with the creping process for tissue webs. Shown is a headbox 1 which deposits an aqueous suspension of papermaking fibers onto an inner forming fabric 3 as it traverses a forming roll 4. An outer forming fabric 5 serves to contain the web 6 while it passes over the forming roll and sheds some of the water. The wet web 6 is then transferred from the inner forming fabric to a wet end transfer fabric 8 with the aid of a vacuum transfer shoe 9. This transfer is preferably carried out with the transfer fabric traveling at a slower speed than the forming fabric (rush transfer) to impart stretch into the final tissue sheet. The wet web is then transferred to the throughdrying fabric 11 with the assistance of a vacuum transfer roll 12.

The throughdrying fabric 11 carries the web over the throughdryer 13, which blows hot air through the web to dry it while preserving bulk. There can be more than one throughdryer in series (not shown), depending on the speed and the dryer capacity. The dried tissue sheet 15 is then transferred to a first dry end transfer fabric 16 with the aid of vacuum transfer roll 17.

The tissue sheet shortly after transfer is sandwiched between the first dry end transfer fabric 16 and the transfer belt 18 to positively control the sheet path. The air permeability of the transfer belt 18 is lower than that of the first dry end transfer fabric 16, causing the sheet to naturally adhere to the transfer belt. At the point of separation, the sheet follows the transfer belt due to vacuum action. The air permeability of the transfer belt 18 can be about 100 cubic feet per minute per square foot of fabric or less, more specifically from about 5 to about 50 cubic feet per minute per square foot, and still more specifically from about 0 to about 10 cubic feet per minute per square foot. Air permeability, which is the air flow through a fabric while maintaining a differential air pressure of 0.5 inch water across the fabric, is described in ASTM test method D737. In addition, the transfer belt 18 is preferably smoother than the throughdrying fabric 11 in order to enhance transfer of the sheet. Suitable low air permeability fabrics for use as transfer belts include, without limitation, COFPA Mononap NP 50 dryer felt (air permeability of about 50 cubic feet per minute per square foot) and Asten 960C (impermeable to air).

The transfer belt 18 passes over two support rolls 21 and 22 before returning to pick up the dried tissue sheet again. The sheet is transferred to the parent roll 25 at a point between the two support rolls 21, 22. The parent roll 25 is wound on a reel spool 26, which is driven by a center drive motor 27 acting on the shaft of the reel spool.

Control of the web properties of the web unwound from the parent roll can be aided by imparting a predetermined amount of web tension to the incoming web during winding, such as by programming the level of speed difference between the transfer belt 18 and the outer surface of the building parent roll 25. In most instances, a positive draw (the percentage by which the speed of the surface of the parent roll exceeds the speed of the transfer belt) is required at the parent roll in order to impart the web tension needed to provide a stable parent roll. On the other hand, too much positive draw will unacceptably reduce the machine direction stretch in the web. Therefore, the amount of positive draw will depend upon the web properties coming into the parent roll and the desired properties of the web to be unwound from the parent roll. Generally, the speed of the surface of the parent roll will be about 10 percent or less faster than the speed of the transfer belt, more specifically from about 0.5 to about 8 percent faster, and still more specifically from about 1 to about 6 percent faster. Of course, if the web approaching the parent roll already has sufficient tension provided by other means earlier in the tissue making process, a negative or zero draw may be desirable.

Figure 2:
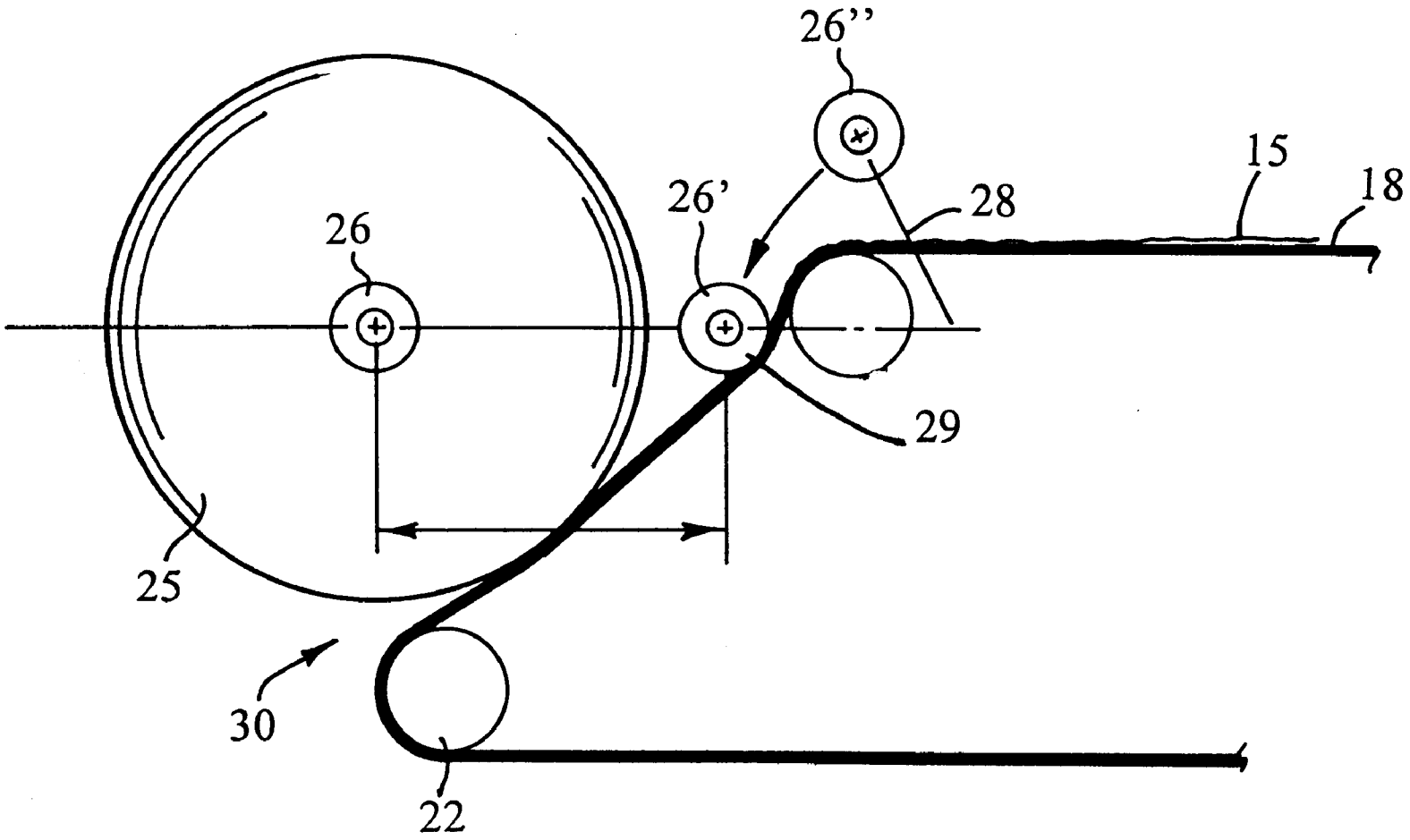
FIG. 2 is a schematic diagram of the winding section of the method illustrated in FIG. 1.

The transfer and winding of the sheet is illustrated in more detail in FIG. 2. In the free span between the two support rolls, 21, 22 the sheet 15 contacts and transfers to the parent roll 25. Reference numbers 26, 26' and 26" illustrate three positions of the reel spool during continuous operation. As shown, a new reel spool 26" is ready to advance to position 26' as the parent roll 25 is building. When the parent roll has reached its final predetermined diameter, the new reel spool is lowered by arm 28 into position 26' against the incoming sheet at some point along the free span between the support rolls, generally relatively close to the first support roll 21, thereby avoiding a hard nip between the support roll and the reel spool.

Figure 3:
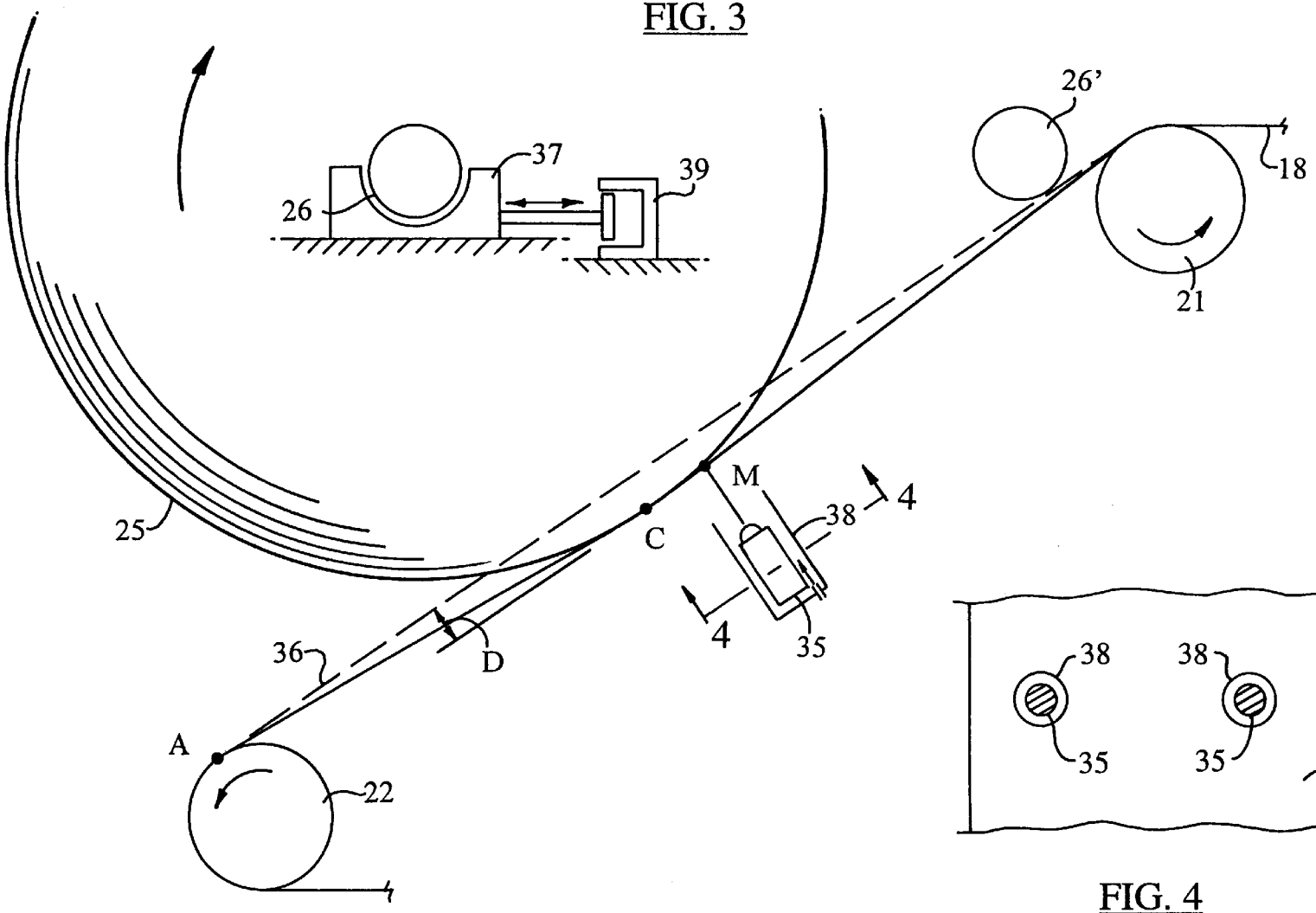
FIG. 3 is an enlarged schematic diagram of the winding section, illustrating the operation of a laser displacement sensor in controlling the transfer belt displacement.

The reel spool 26 is supported appropriately by a pair of carriages 37, one of which is illustrated in FIG. 3. As the parent roll 25 builds, the reel spool moves toward the other support roll 22 while at the same time moving away from the transfer belt 18. The reel spool 26 can be moved in either direction by a hydrauic cylinder 39 as illustrated by the double-ended arrow to maintain the proper transfer belt deflection needed to minimize the variability of the sheet properties during the winding process. As a result, the parent roll nip substantially traverses the free span as the roll builds to its predetermined size. At the appropriate time, one or more air jets 30 serve to blow the sheet back toward the new reel spool 26' in order to attach the sheet to the new reel spool In particular, the reel spool 26 may comprise a conventional vacuum reel 29 such that vacuum suction from within the reel spool helps to hold the web and initiate the winding process. As the sheet is transferred to the new reel spool, the sheet is broken and the parent roll 25 is kicked out to continue the winding process with a new reel spool.

Control of the relative positions of the reel spool 26 and the transfer belt 18 is suitably attained using a non-contacting sensing device 35 which is focused on the inside of the transfer belt, preferably at a point M midway between the two support rolls 21, 22 as shown in FIG. 3. One object is to minimize and control the pressure exerted by the parent roll 25 against the sheet supported by the transfer belt 18 as well as minimize the nip length created by the contact. The sensing device 35, such as a laser displacement sensor discussed below, detects changes in transfer belt deflection of as small as 0.005 inches. A predetermined baseline value from which the absolute amount of deflection D can be ascertained is the undeflected path of travel of the transfer belt 18 in the free span, which is identified by reference number 36.

A particularly suitable laser sensing device 35 is laser displacement sensor Model LAS-8010, manufactured by Nippon Automation Company, Ltd. and distributed by Adsens Tech Inc. The Nippon Automation LAS 8010 sensor has a focused range of 140 to 60 mm and is connected to a programmable logic controller. The front plate of the sensor can be mounted 120 mm. from the inside surface of the transfer belt. The laser sensor 35 is preferably mounted within an air purge tube 38 which maintains an air flow around the laser to prevent dust from settling on the lens of the laser and interfering with the operation of the device. Such a sensor is designed to give a 4 to 20 mA output in relation to the minimum to maximum distance between the sensor and the transfer belt. The winder is first operated without a roll 25 loaded against the transfer belt 18 to set the zero point in the programmable logic controller based on the undeflected path of travel 36 of the transfer belt.

Although a preferred laser sensor is discussed above, several other suitable non-contacting and contacting sensing devices are well known in the art. Several are described by F. T. Farago and M. A. Curtis in *Handbook of Dimensional Measurements*, 3rd Ed., Industrial Press, Inc., New York, 1994. Such methods include laser-based distance or depth sensing devices using techniques such as laser triangulation; laser white light or multiple wavelength moire interferometry, as illustrated by Kevin Harding, "Moire Inteferometry for Industrial Inspection," *Lasers and*

*Applications*, Nov. 1993, pp. 73–78, and Albert J. Boehnlein, "Field Shift Moire System," U.S. Pat. No. 5,069,548, Dec. 3, 1991; ultrasonic sensing, including methods described in L. C. Lynnworth, *Ultrasonic Measurements for Process Control*, Academic Press, Boston, 1989, and particularly the method of measuring the delay time for an ultrasonic signal reflected off a solid surface; microwave and radar wave reflectance methods; capacitance methods for determination of distance; eddy current transducer methods; single-camera stereoscopic imaging for depth sensing, as illustrated by T. Lippert, "Radial parallax binocular 3D imaging" in Display System Optics II, Proc. SPIE Vol. 1117, pp. 52–55 (1989); multiple-camera stereoscopic imaging for depth sensing, as illustrated by N. Alvertos, "Integration of Stereo Camera Geometries" in Optics, Illumination and Image Sensing for Machine Vision IV., Proc. SPIE, Vol. 1194, pp. 276–286 (1989); contacting probes such as rollers, wheels, metal strips, and other devices whose position or deflection is measured directly; and the like.

Once the transfer belt deflection D has been measured, a proportional only control loop associated with the programmable logic controller preferably maintains that deflection at a constant level. In particular, the output of this control is the setpoint for a hydraulic servo positioning control system for the carriages 37 which hold the reel spool 26 and building parent roll. Other mechanical and electrical actuators for positioning the reel spool 26 in response to the sensor input which may be suitable for achieving this objective can be designed and constructed by those skilled in the art of building high speed winders. When the transfer belt deflection D exceeds the setpoint, the carriage position setpoint is increased, moving the carriages 37 away from the fabric to return the deflection back to the setpoint.

Figure 4:
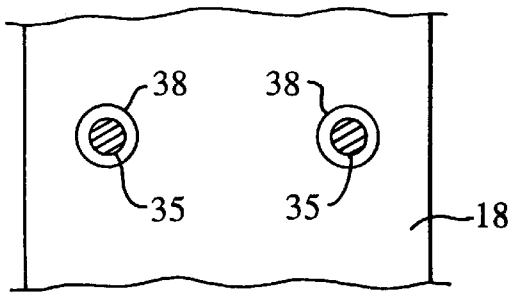
FIG. 4 is a partial sectional view taken through line 4—4 of FIG. 3.

The transfer belt deflection control may use two laser distance sensors 35 each adjacent a respective edge of the transfer belt 18 so as to be spaced from each other in the cross machine direction as can be seen in FIG. 4. As such, undesirable tapering of the roll 25 can be minimized or a positive taper can even be introduced intentionally to improve the winding parameters of the particular roll being wound.

A specific hydraulic servo positioning system consists of Moog servo valves controlled by an Allen-Bradley QB module with Temposonic transducers mounted on the rods of the hydraulic cylinders 39 to determine position. The output from the deflection control loop is the input to two individual servo positioning systems on either side of the reel. Each system can then control, keeping the two sides of the reel parallel if desired. A protection system that stops the operation if the parallelism exceeds a certain threshold level may be desirable, but it is not necessary to have an active system to keep the two sides parallel.

The extent to which the transfer belt 18 is deflected is suitably maintained at a level of about 20 millimeters or less, more specifically about 10 millimeters or less, still more specifically about 5 millimeters or less, and still more specifically from about 1 to about 10 millimeters. In particular, the control system preferably maintains the actual transfer belt deflection at the nip at a level of about 4 mm±2 mm. Maintaining the transfer belt deflection within this range has been found to allow the parent roll 25 and the transfer belt 18 to operate with a relative speed differential but without significant power transfer. This will allow control of the winding process to maintain substantially constant sheet properties throughout the parent roll 25, which heretofore has not been possible for such sheets using conventional winders.

Deflection is measured perpendicular to the undeflected path of travel 36 of the transfer belt 18. It would be appreciated that the acceptable amount of deflection for any given tissue sheet is in part determined by the design of the transfer belt 18 and the tension imparted to the transfer belt during operation. As the tension is reduced, the acceptable amount of deflection will increase because the compression of the sheet is reduced and the amount of power transferred to the parent roll 25 is further reduced. In turn, the variability in the properties of the wound sheet is reduced. In addition, it may not always be desirable to maintain the amount of transfer belt deflection D at a substantially constant level and it is within the scope of the invention that the amount of deflection may be controllably varied as the roll 25 increases in diameter.

The sensed deflection D of the transfer belt 18 in combination with the sensed position of the reel spool carriages 37 may also be used to calculate the diameter of the building parent roll 25. The value calculated for the diameter of the roll can be useful in varying other operating parameters of the winding process including the rotational velocity at which the reel spool 26 is rotated by the drive motor 27 to maintain the same draw or speed relationship between the outer surface of the parent roll 25 and transfer belt 18 as the diameter of the parent roll increases.

The laser sensor 35 can be positioned to always measure the deflection of the transfer belt 18 at the midpoint of the free span, regardless of the parent roll position, and the actual deflection can be calculated as described below. Alternatively, the laser sensor 35 can traverse the free span with the parent roll nip such that the laser always measures the deflection directly. A further alternative is to mount the laser sensor 35 for rotation so that the laser light source can be rotated to maintain a desired aim on the transfer belt 18.

In the situation where the laser position is fixed at the midpoint of the free span and the deflection is measured by the laser 35 at that point, the actual deflection at the parent roll nip point is calculated according to the position of the building parent roll 25, which traverses from one end of the open span to the other on the carriages 37 while it builds. Since the laser 35 is mounted in the middle of the free span of the transfer belt 18 between the two support rolls 21, 22 and only measures the deflection of the transfer belt at that position, the actual deflection at the nip is closely approximated by the measured deflection in the middle of the free span times the following ratio: the distance from the laser measurement point M to the nip point of the support roll nearest the nip point C of the parent roll (support roll 22 in FIG. 3) divided by the distance from the nip point of the parent roll to the nip point of that same support roll. For purposes of this calculation, the nip points of the support rolls are the tangent points at which the undeflected path of travel 36 of the transfer belt in the free span contacts the support rolls. The nip point C of the parent roll is the midpoint of the wrap of the transfer belt 18 around the periphery of the parent roll 25.

This is illustrated in FIG. 3, where the actual deflection D is the measured deflection at point M (the midpoint of the free span) times the ratio of the distance MA to the distance CA. If the parent roll 25 were precisely in the middle of the free span, the ratio would be 1 and the laser would be measuring the actual deflection D. However, when the parent roll 25 is positioned on either side of the midpoint of the free span, the deflection of the transfer belt measured by the laser at the midpoint is always less than the actual deflection at the transfer point.

The length of the unsupported span between the support rolls 21, 22 needs to be long enough to allow the new reel spool 26' to be placed between the first or upstream support roll 21 and the fully-built parent roll. On the other hand, the free span needs to be short enough to prevent sagging of the fabric so that the amount of tension can be minimized and the degree of deflection can be controlled. A suitable free span length can be from about 1 to about 5 meters, more specifically from about 2 to about 3 meters.

The advantages of the apparatus and method according to the present invention allow the production of parent rolls of tissue having highly desirable properties. In particular, parent rolls of high bulk tissue can be manufactured having a diameter of about 70 inches or greater, wherein the bulk of the tissue taken from the roll is about 9 cubic centimeters per gram or greater, the coefficient of variation of the finished basis weight is about 2% or less and the coefficient of variation of the machine direction stretch is about 6% or less. In addition, the coefficient of variation of the sheet bulk for tissue sheets taken from the parent roll can be about 3.0 or less.

More specifically, the diameter of the parent roll can be from about 100 to about 150 inches or greater. The coefficient of variation of the finished basis weight can be about 1% or less. The coefficient of variation of the machine direction stretch can be about 4% or less, still more specifically about 3% or less. The coefficient of variation of the sheet bulk can be about 2.0 or less.

As used herein, high bulk tissues are tissues having a bulk of 9 cubic centimeters or greater per gram before calendering. Such tissues are described in U.S. Pat. No. 5,607,551 issued Mar. 4, 1997 to Farrington, Jr. et al. entitled "Soft Tissue", which is herein incorporated by reference. More particularly, high bulk tissues for purposes herein can be characterized by bulk values of from 10 to about 35 cubic centimeters per gram, more specifically from about 15 to about 25 cubic centimeters per gram. The method for measuring bulk is described in the Farrington, Jr. et al. patent.

In addition, the softness of the high bulk tissues of this invention can be characterized by a relatively low stiffness as determined by the MD Max Slope and/or the MD Stiffness Factor, the measurement of which is also described in the Farrington, Jr. et al. patent. More specifically, the MD Max Slope, expressed as kilograms per 3 inches of sample, can be about 10 or less, more specifically about 5 or less, and still more specifically from about 3 to about 6. The MD Stiffness Factor, expressed as (kilograms per 3 inches)-microns$^{0.5}$, can be about 150 or less, more specifically about 100 or less, and still more specifically from about 50 to about 100.

Furthermore, the high bulk tissues of this invention can have a machine direction stretch of about 10 percent or greater, more specifically from about 10 to about 30 percent, and still more specifically from about 15 to about 25 percent. In addition, the high bulk tissues of this invention suitably can have a substantially uniform density since they are preferably throughdried to final dryness without any significant differential compression.

An advantage of the method of this invention is the resulting improved uniformity in the sheet properties unwound from the parent roll. Very large parent rolls can be wound while still providing substantial sheet uniformity due to the control of the winding pressure on the sheet. Another advantage of the method of this invention is that soft, high bulk tissue sheets can be wound into parent rolls at high speeds. Suitable machine speeds can be from about 3000 to about 6000 feet per minute or greater, more specifically from about 4000 to about 6000 feet per minute or greater, and still more specifically from about 4500 to about 6000 feet per minute.

Many modifications and other embodiments of the invention will come to mind to one skilled in the art to which this invention pertains having the benefit of the teachings presented in the foregoing descriptions and the associated drawings. For example, the apparatus and method according to the present invention are not limited to use with only tissue, but may also be highly advantageous in winding all types of web materials, including other forms of paper such as paperboard. Therefore, it is to be understood that the invention is not to be limited to the specific embodiments disclosed and that modifications and other embodiments are intended to be included within the scope of the appended claims. In addition, although specific terms are employed herein, they are used in a generic and descriptive sense only and not for purposes of limitation.

That which is claimed:

1. An apparatus for winding a web of paper material into a roll, said apparatus comprising:

a rotatably mounted reel spool;

a drive motor for rotating said reel spool and winding a web of paper material thereon to create a roll of increasing diameter;

an endless flexible member mounted for rotation along a predetermined path of travel, said flexible member being positioned adjacent to said reel spool to engage the web against said reel spool during winding such that said flexible member is deflected from the predetermined path of travel by an amount relative to the amount of paper material wound on said reel spool;

a deflection sensor mounted adjacent to said flexible member, said deflection sensor being arranged to measure the amount of deflection of said flexible member from said predetermined path of travel;

an actuator for positioning said reel spool and said flexible member relative to each other to vary the amount of deflection of said flexible member; and a controller connected to said deflection sensor and said actuator for controlling the amount of deflection of said flexible member as the roll increases in diameter.

2. An apparatus as defined in claim 1 wherein said deflection sensor further comprises a laser light source for directing laser light onto said flexible member and a receiver spaced from said light source for receiving laser light reflected from said flexible member.

3. An apparatus as defined in claim 2 wherein said laser light source is mounted for rotation so that the laser light source can be rotated to maintain a desired aim on said flexible member.

4. An apparatus as defined in claim 2 wherein said laser light source is mounted within an air purge tube for preventing dust from interfering with the laser light source.

5. An apparatus as defined in claim 1 wherein said reel spool is rotatably mounted at either end on a translatable carriage and said actuator further comprises a hydraulic cylinder connected to each of said carriages.

6. An apparatus as defined in claim 1 further comprising an air jet for turning up an initial portion of the web of paper material onto said reel spool.

7. An apparatus as defined in claim 1 wherein said reel spool is a vacuum reel for causing an initial portion of the web of paper material to adhere to said reel spool.

8. An apparatus for winding a web of paper material into a roll, said apparatus comprising:

a rotatably mounted reel spool;

a drive motor for rotating said reel spool and winding a web of paper material thereon to create a roll of increasing diameter;

an endless flexible belt supported for rotation around a plurality of support rolls and defining a predetermined path of travel including a free span between a pair of neighboring support rolls, said belt being positioned adjacent to said reel spool to engage the web against said reel spool during winding such that said free span of said belt is deflected from the predetermined path of travel by an amount relative to the amount of paper material wound on said reel spool;

a deflection sensor mounted within said belt and opposite said reel spool, said deflection sensor being arranged to measure the amount of deflection of said belt from said predetermined path of travel;

an actuator for positioning said reel spool and said belt relative to each other to vary the amount of deflection of said belt; and a controller connected to said deflection sensor and said actuator for controlling the amount of deflection of said belt as the roll increases in diameter.

9. An apparatus as defined in claim 8 wherein said deflection sensor further comprises a laser light source for directing laser light onto said belt and a receiver spaced from said light source for receiving laser light reflected from said belt.

10. An apparatus as defined in claim 9 wherein said laser light source and said receiver are positioned adjacent one edge of said belt and further comprising a second laser light source and second receiver positioned adjacent an opposite edge of said belt.

11. An apparatus as defined in claim 8 wherein said belt has an air permeability of not greater than about 100 cubic feet per minute per square foot at a differential air pressure of 0.5 inches of water.

12. An apparatus as defined in claim 8 wherein said belt is impermeable to air.

13. An apparatus as defined in claim 8 wherein said belt is driven independently of said reel spool.

14. An apparatus as defined in claim 13 wherein said reel spool is rotated at a speed such that the linear surface speed of the roll is not greater than about 10% faster than the linear speed of said belt.

15. An apparatus as defined in claim 14 wherein said reel spool is rotated at a speed such that the linear surface speed of the roll is between about 1–6% faster than the linear speed of said belt.

16. An apparatus as defined in claim 8 wherein said deflection sensor is mounted in a fixed position midway along said free span of said belt.

17. An apparatus as defined in claim 8 wherein the deflection of said belt is maintained below about 20 millimeters.

18. An apparatus as defined in claim 17 wherein the deflection of said belt is maintained between about 1–10 millimeters.

19. An apparatus as defined in claim 8 wherein said free span of said belt between said neighboring support rolls is between about 1–5 meters.

20. An apparatus as defined in claim 19 wherein said free span of said belt between said neighboring support rolls is between about 2–3 meters.

21. A method of winding a web of paper material to form a roll, said method comprising the steps of:

engaging an endless flexible member against a reel spool such that said flexible member is deflected from a predetermined path of travel;

rotating the reel spool;

rotating the endless flexible member with the reel spool to create a nip;

advancing the web of paper material into the nip and directing the web around the reel spool to form a roll of increasing diameter;

sensing the amount of deflection of the flexible member by the roll as the diameter of the roll increases; and moving at least one of the reel spool and the flexible member away from the other in response to said sensing step to vary the amount of deflection of the flexible member.

22. A method of winding as defined in claim 21 wherein said sensing step further comprises the steps of:

directing laser light onto a surface of the flexible member opposite the roll;

receiving a reflection of the laser light from the surface of the flexible member; and calculating the deflection of the flexible member relative to a baseline value.

23. A method of winding as defined in claim 21 wherein said rotating steps further comprise rotating the reel spool at a rotational velocity which causes the outer periphery of the roll to have a linear speed at the nip not greater than about 10% faster than the linear speed of the flexible member at the nip.

24. A method of winding as defined in claim 21 comprising the steps of:

sensing the position of the reel spool relative to the predetermined path of the flexible member;

calculating the diameter of the roll from the sensed position of the reel spool and the deflection of the flexible member; and varying the rotational velocity of the reel spool such that the linear speed of the outer periphery of the roll maintains a predetermined relationship with the linear speed of the flexible member at the nip as the diameter of the roll increases.

25. A method of winding as defined in claim 21 wherein said moving step further comprises moving the reel spool away from the flexible member as the diameter of the roll increases.

* * * * *